US009845651B2

(12) United States Patent
McCoy et al.

(10) Patent No.: US 9,845,651 B2
(45) Date of Patent: Dec. 19, 2017

(54) RETRIEVABLE DOWNHOLE TOOL SYSTEM

(71) Applicant: FORUM US, INC., Houston, TX (US)

(72) Inventors: Mark McCoy, Houston, TX (US); Benny Layton, Tulsa, OK (US); Michael J. Harris, Houston, TX (US); William M. Roberts, Tulsa, OK (US)

(73) Assignee: FORUMS US, INC., Houston, TX (US)

( * ) Notice: Subject to any disclaimer, the term of this patent is extended or adjusted under 35 U.S.C. 154(b) by 324 days.

(21) Appl. No.: 14/659,197

(22) Filed: Mar. 16, 2015

(65) Prior Publication Data

US 2015/0260008 A1 Sep. 17, 2015

Related U.S. Application Data

(60) Provisional application No. 61/954,238, filed on Mar. 17, 2014.

(51) Int. Cl.
*E21B 33/129* (2006.01)
*E21B 23/06* (2006.01)
*E21B 33/134* (2006.01)

(52) U.S. Cl.
CPC ..... *E21B 23/06* (2013.01); *E21B 33/129* (2013.01); *E21B 33/134* (2013.01)

(58) Field of Classification Search
None
See application file for complete search history.

(56) References Cited

U.S. PATENT DOCUMENTS 3,457,992 A * 7/1969 Brown ..... E21B 33/043 166/335
4,432,418 A * 2/1984 Mayland ..... E21B 23/06 166/123
5,048,613 A * 9/1991 Shilling ..... E21B 23/06 166/123
5,333,685 A * 8/1994 Gilbert ..... E21B 23/06 166/123
5,441,111 A * 8/1995 Whiteford ..... E21B 33/1293 166/123
6,131,656 A * 10/2000 Jani ..... E21B 33/1293 166/192
6,942,039 B2 9/2005 Tinker
7,082,991 B2 8/2006 Sommers et al.
2006/0272828 A1* 12/2006 Manson ..... E21B 23/006 166/387
2011/0036564 A1* 2/2011 Williamson ..... E21B 33/1294 166/188

(Continued)

*Primary Examiner* — Shane Bomar

(57) ABSTRACT

A downhole tool, a retrievable bridge plug system, and a method. The downhole tool includes a release mandrel, a plurality of slips disposed at least partially around the release mandrel, an upper cone disposed at least partially around the release mandrel and on a first axial side of the plurality of slips, a lower cone disposed at least partially around the outer mandrel and on a second axial side of the plurality of slips, and a collet positioned axially and radially between the release mandrel and the lower cone. The collet is configured to prevent downward movement of the lower cone relative to the release mandrel at least when the downhole tool is in a run-in configuration and when the downhole tool is in a set configuration.

20 Claims, 6 Drawing Sheets

(56) References Cited

U.S. PATENT DOCUMENTS

2011/0308819 A1* 12/2011 Frazier ..... E21B 33/1204
166/387
2016/0138363 A1* 5/2016 Sommers ..... E21B 23/06
166/387

* cited by examiner

RETRIEVABLE DOWNHOLE TOOL SYSTEM

CROSS-REFERENCE TO RELATED APPLICATIONS

This application claims priority to U.S. Provisional Patent Application No. 61/954,238, which was filed on Mar. 17, 2014, and is incorporated herein by reference in its entirety.

BACKGROUND

In the oilfield industry, various downhole tools (e.g., packers, bridge plugs, frac plugs) may be used to isolate sections of a wellbore. Such downhole tools may include a sealing element, which is generally made of rubber, and slips configured to bite into a surrounding tubular and maintain a position of the tubular in the wellbore. The sealing element and slips may initially be in a contracted configuration, allowing the downhole tool to be run into the wellbore without engaging the wellbore or any other surrounding tubular.

Upon reaching a desired location, such as an interface between two formation zones, the tool may be set. As part of the setting process, the slips and the sealing element may be expanded so as to engage the surrounding tubular (e.g., casing, liner, wellbore wall), which may provide the desired zonal isolation.

Such downhole tools may be retrievable or non-retrievable. In the latter case, the tools are generally removed by drilling them out. With retrievable tools, on the other hand, a retrieval tool may be provided that attaches to the wireline (or another suitable line), which may engage with the downhole tool. Using the retrieval tool, the sealing element and the slips may be disengaged from the surrounding tubular and pulled out of the wellbore.

In use, a large pressure differential may develop across the downhole tool. At some point, this pressure differential may cause the downhole tool to fail. Such failure may be caused by the slips applying an insufficient holding force, the sealing elements failing to provide a seal, or by shearable elements of the downhole tool's setting assembly failing under this pressure.

SUMMARY

Embodiments of the disclosure may provide a downhole tool including a release mandrel, a plurality of slips disposed at least partially around the release mandrel, an upper cone disposed at least partially around the release mandrel and on a first axial side of the plurality of slips, and a lower cone disposed at least partially around the release mandrel and on a second axial side of the plurality of slips. The downhole tool may also include a collet positioned axially and radially between the release mandrel and the lower cone. The collet is configured to prevent downward movement of the lower cone relative to the release mandrel at least when the downhole tool is in a run-in configuration and when the downhole tool is in a set configuration.

Embodiments of the disclosure may also provide a retrievable bridge plug system. The system includes a bride plug including a release mandrel including an upper connection, an outer mandrel coupled to the release mandrel by one or more shear devices, a plurality of slips disposed at least partially around the release mandrel, an upper cone disposed at least partially around the release mandrel and on a first axial side of the plurality of slips, a lower cone disposed at least partially around the release mandrel and on a second axial side of the plurality of slips, and a collet coupled with the outer mandrel and positioned axially and radially between the release mandrel and the lower cone. The collet is configured to prevent downward movement of the lower cone relative to the release mandrel at least when the bridge plug is in a set configuration. The system may also include a retrieval tool having an upper end and a lower end, with the retrieval tool being configured to receive the upper connection of the release mandrel though the lower end, and to shear the one or more shear devices, so as to move the bridge plug from a set configuration to a retrieval configuration.

Embodiments of the present disclosure may also provide a method for running and retrieving a downhole tool into a surrounding tubular. The method includes coupling an adapter to the downhole tool. The downhole tool includes a release mandrel including an upper connection coupled with the adapter, a plurality of slips disposed at least partially around the release mandrel, an upper cone disposed at least partially around the release mandrel and on a first axial side of the plurality of slips, a lower cone disposed at least partially around the release mandrel and on a second axial side of the plurality of slips, and a collet positioned axially and radially between the release mandrel and the lower cone. The collet is configured to prevent downward movement of the lower cone relative to the release mandrel, when the downhole tool is in a run-in configuration. The method further includes running the downhole tool into the surrounding tubular using the adapter, setting the downhole tool into a set configuration in the surrounding tubular using the adapter, and releasing the downhole tool from the adapter.

BRIEF DESCRIPTION OF THE DRAWINGS

The present disclosure may best be understood by referring to the following description and accompanying drawings that are used to illustrate one or more embodiments. In the drawings.

DETAILED DESCRIPTION

Figure 1A:
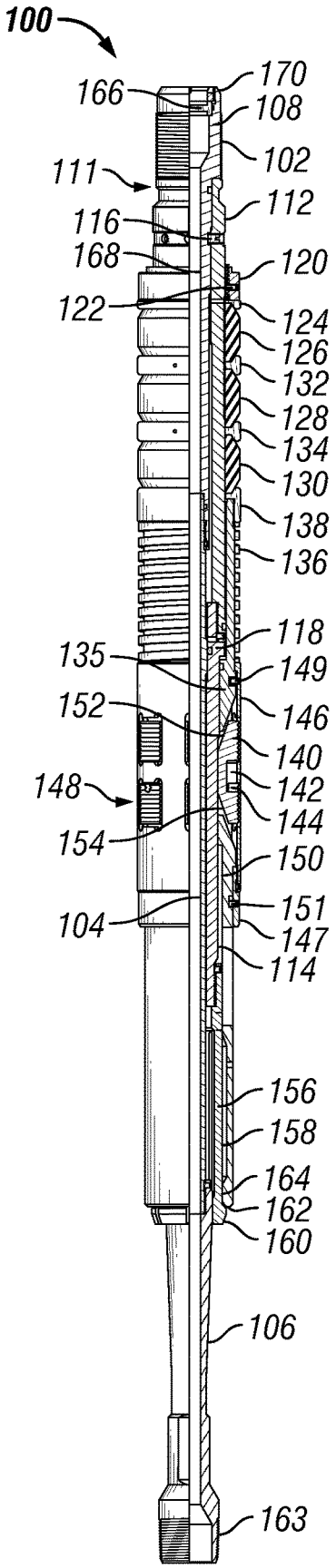
FIG. 1A illustrates a side, quarter-sectional view of a downhole tool, according to an embodiment.

Embodiments of the present disclosure may provide a downhole tool, e.g., a bridge plug, that may be capable of withstanding high pressure, e.g., 10 kpsi or greater, in a wellbore. The tool may include slips that engage a surrounding tubular, as well as a setting assembly that includes upper and lower cones. The tool may also include sealing elements to seal with the surrounding tubular. Further, the tool may include a collet that is wedged between a central release mandrel of the tool and the lower cone, which prevents the lower cone from moving away from the slips, such that, as the upper cone is driven downwards during setting, the lower cone maintains its position. With such configuration, pressure on the cones may tend to further expand the slips into engagement with the surrounding tubular, as will be described in greater detail below.

The present disclosure may also provide embodiments of an adapter for a setting tool that may be employed with the downhole tool, as well as a retrieval tool that may be employed therewith. In particular, the tool may include a rupture disk, e.g., proximal to an upper end thereof, which may prevent fluid communication through a bore defined through the tool. In combination with the sealing elements, this may result in a fluid-tight seal provided by the tool. The retrieval tool may include a probe that fractures this rupture disk, thereby providing fluid communication through the bore of the tool, and relieving the pressure that, as mentioned above, may drive the slips further into engagement with the wellbore.

These are but a few aspects of the presently disclosed device and methods. Additional aspects will become apparent from the description of embodiments below, with reference to the figures.

Before turning to the specific embodiments, however, it will be noted that the following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

In some contexts, "downhole" (e.g., "downhole tool") may refer to a component that is configured to be disposed in the wellbore. Directional terms such as "up," "upper," "down," "lower," "above," "below," "upward," "downward," etc. may be used for the sake of convenience to refer to the illustrated embodiments; however, these terms are intended to refer to the positioning of the elements relative to one another, and not to limit the embodiments to any particular frame of reference or perspective. Accordingly, for example, "upper" and "lower" may mean "closer to the surface" and "farther into a wellbore," respectively, when used in the context of an apparatus disposed in a wellbore, acknowledging that wellbores may be non-vertical, e.g., deviated or horizontal.

FIG. 1A illustrates a side, quarter-sectional view of a downhole tool 100, e.g., in a run-in configuration, according to an embodiment. The downhole tool 100 may be, for example, a bridge plug, which may prevent fluid communication from the top end to the bottom end, at least prior to retrieval, as will be described below. In other embodiments, the tool 100 may be a frac plug, another type of plug, a packer, or another tool configured to be disposed in a wellbore.

The tool 100 may include a release mandrel 102 which may be a single piece that extends from one end of the tool 100 to the other, but in other embodiments, may include an intermediate inner mandrel 104 and a lower mandrel 106, as shown. It will be appreciated that the term "mandrel" may include a single, unitary piece or two or more pieces coupled together. The release mandrel 102 may provide an upper connection 108, which may be configured to engage with an adapter and/or retrieval tool, as will be described below. In an embodiment, the upper connection 108 may include external threads 110 which may provide for such engagement, but in other embodiments, internal threads, or other engaging members may be provided.

The tool 100 may also include an outer mandrel, which may be provided as a single piece, or may, as shown, include an upper, outer mandrel 112 and a lower, outer mandrel 114. The upper, outer mandrel 112 may be disposed at least partially around the release mandrel 102, and may be connected thereto by one or more shear devices, such as a shear screw 116. In other embodiments, other types of shear devices may be used, such as adhesives, welds, shear pins, shear rings, etc. The upper, outer mandrel 112 may include a recess 111, positioned proximal to the upper connection 108, which may provide for engagement with a collet of a setting tool, as will be described in greater detail below. The lower, outer mandrel 114 may be disposed at least partially around the intermediate mandrel 104, and may be coupled on an upper axial end with a lower axial end of the upper, outer mandrel 114. Further, the lower, outer mandrel 114 may define a shoulder 118, proximal to an axial upper end thereof.

A lock-ring housing 120 may be disposed at least partially around the upper, outer mandrel 114, e.g., engaging threads formed in the upper, outer mandrel 114. The lock-ring housing 120 may be movable downward, but, through the engagement with threads on the upper, outer mandrel 114, may be prevented from moving upwards, e.g., providing a ratcheting mechanism. Moreover, a shear screw (or another shearable structure) 122 may be received through the lock-ring housing 120 and prevent the lock ring disposed with the lock-ring housing 120 from rotating with respect thereto.

A gage ring 124 may be positioned below the lock-ring housing 120. Further, the tool 100 may include one or more sealing elements, e.g., a first sealing element 126, a second sealing element 128, and a third sealing element 130. The first, second, and third sealing elements 126, 128, 130 may be separated from one another by spacers 132, 134, as shown. Further, the gage ring 124 may be positioned between the first sealing element 126 and the lock-ring housing 122, e.g., to control the deformation of the first sealing element 126 during the setting process. The sealing elements 126, 128, 130 may be formed from rubber of any suitable hardness or may be formed from other materials.

The tool 100 may also include an upper cone 135 and a follower spring 136. The upper cone 135 and the follower spring 136 may be disposed at least partially around one or both of the upper, outer mandrel 112 and the lower, outer mandrel 114. The follower spring 136 may bear against a retainer 138 and may engage the third sealing element 130, similarly to the gage ring 124 engaging the first sealing element 126. The first, second, and third sealing elements 126, 128, 130 may be axially compressed, and thereby radially expanded, between the gage ring 124 and the retainer 138 during the setting process, as will be described below.

The tool 100 may also include slips 140, which may be disposed at least partially around, e.g., at circumferential intervals, the intermediate mandrel 104 and the lower, outer mandrel 114. The slips 140 may be biased radially inwards by a slip spring 142, which may be received in a groove 144 formed in the slips 140. The groove 144 may, in a specific example, be formed proximal an axial middle of the slips 140, as shown, but in other embodiments, may be formed elsewhere, e.g., proximal the axial ends thereof.

A slip cage 146 may be disposed around the slips 140, and may provide openings 148. The slips 140 may extend radially outwards through the openings 148, e.g., when the slips 140 are expanded outwards during setting, as will be described below. Further, the slip cage 146 may be coupled with a slip cage cap 147 on a lower end thereof and may be coupled with the upper cone 135 via a shear screw 149 (or another shearable structure).

Furthermore, the tool 100 may include a lower cone 150. The upper cone 135 and the lower cone 150 may be disposed on opposite axial sides of the slips 140. The slip cage cap 147 may be connected with the lower cone 150 via a shear screw 151 (or another shearable structure). Further, the upper cone 135 and the lower cone 150 may be generally wedge-shaped or tapered in cross-section (e.g., conical or frustoconical), and may be configured to bear on reverse-tapered surfaces 152, 154 on either axial side of the slips 140. Accordingly, when the upper cone 135 and the lower cone 150 are driven axially toward one another, the upper cone 135 and lower cone 150 may drive the slips 140 radially outwards. It will be appreciated that either or both of the upper and lower cones 135, 150, may individually be provided as a single, elongated piece with a tapered end to engage the plurality of slips 140, or may be provided as two or more pieces to provide this functionality The tool 100 may further include a lower collet 156, which may be attached to the lower, outer mandrel 114, e.g., via threads. The lower collet 156 may include a plurality of circumferentially separated fingers 158, which may terminate with protrusions 160 on the lower ends thereof. The protrusions 160 may extend axially downwards from a lower end 162 of the lower cone 150. The lower end 162 of the lower cone 150 may define a radially-inward protrusion 164, which may engage with the protrusion 160 of the lower collet 156.

The lower mandrel 106 may be tapered, extending to a larger diameter as proceeding upwards. Further, the lower mandrel 106 may be sized to retain the lower collet 156 in engagement with the lower cone 150, e.g., by preventing the fingers 158 from deflecting inwards such that the protrusions 160 may disengage from the protrusion 164 of the lower end 162 of the lower cone 150. Thus, the lower collet 156 may be held both radially and axially between the lower mandrel 106 (e.g., part of the release mandrel 102) and the lower cone 150, thereby preventing downward movement of the lower cone 135 by transmitting forces to the lower mandrel 106. Also, optionally toward the bottom of the tool 100, the lower mandrel 106 may also include a lower connection 163 which may be, in a specific example, externally threaded as shown.

The tool 100 may also include a rupture disk 166, e.g., toward the top of the tool 100. Moreover, the release mandrel 102 and the lower mandrel 106 may be hollow, defining a generally continuous bore 168 therethrough. The rupture disk 166 may obstruct the bore 168, thereby preventing the communication therethrough, and permitting the tool 100 to maintain a pressure differential from above the tool 100 to below the tool 100, e.g., to permit zonal isolation. The rupture disk 166 may be held in place with respect to the release mandrel 102 by a keeper 170, which may be threaded or otherwise attached to the release mandrel 102. The rupture disk 166 may be connected to the keeper 170 or may be pressed against a shoulder of the release mandrel 102 by the keeper 170. In other embodiments, any suitable assembly for maintaining the rupture disk 166 in position may be employed.

Figure 1B:
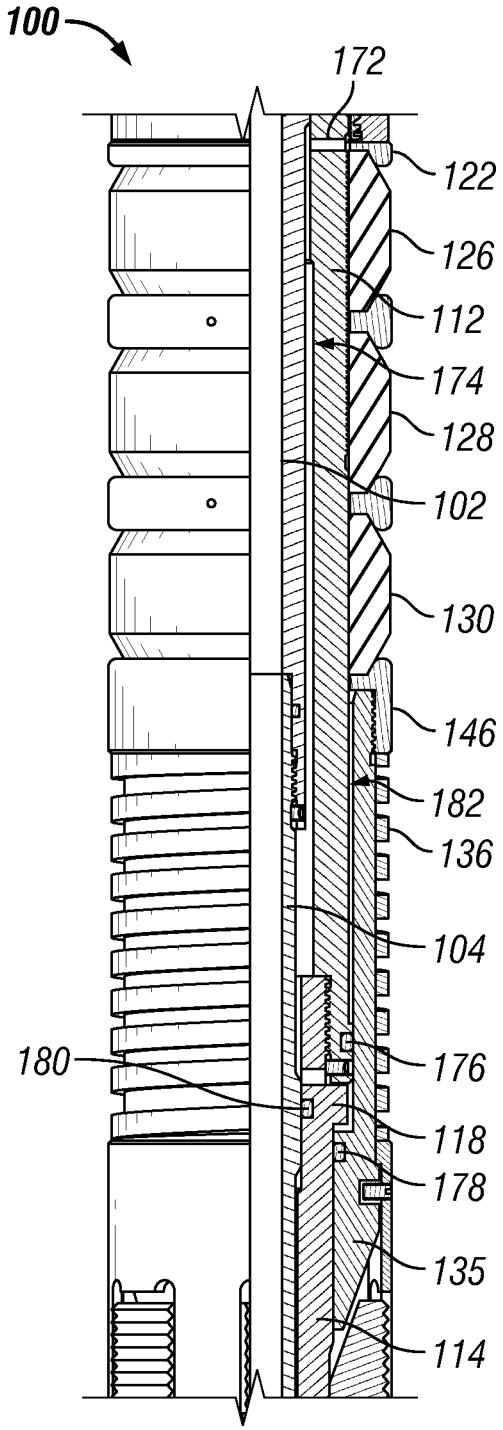
FIG. 1B illustrates an enlarged, side, quarter-sectional view of a portion of the downhole tool of FIG. 1A, according to an embodiment.

FIG. 1B illustrates an enlarged view of a portion of the downhole tool 100 of FIG. 1A, according to an embodiment. As shown, the downhole tool 100 may include a pressure port 172, which may be positioned such that it is above the sealing elements 126, 128, 130 when the downhole tool 100 is in a set configuration (the pre-set, run-in configuration is shown in FIG. 1B). In the illustrated, run-in configuration, the pressure port 172 may be generally aligned with the gage ring 124, or positioned elsewhere, e.g., near the top of the first sealing element 126, so as to result in the pressure port 172 being located above the first sealing element 126 when the tool 100 is set. A pressure channel 174 may be defined radially between the release mandrel 102 and the upper, outer mandrel 112, and may extend axially, inward of the follower spring 136, until turning radially outwards at the shoulder 118 of the lower, outer mandrel 114 and meeting the upper cone 135. The pressure channel 174 may terminate at fluid-tight seals provided by O-rings (or any other suitable sealing members), such as an O-ring 176 between the upper cone 135 and the upper, outer mandrel 112, an O-ring 178 between the upper cone 135 and the lower, outer mandrel 114, and an O-ring 180 between the release mandrel 102 and the lower, outer mandrel 114. Accordingly, the pathway established from above the first sealing element 126 to the upper cone 135 may communicate the pressure above the tool 100, past the sealing elements 126, 128, 130, and to the upper cone 135. When the pressure above the tool 100 is the higher pressure, this pressure may drive the upper cone 135 into engagement with the slips 140.

A second pathway for pressure communication with the upper cone 135 may be also be established, e.g., from the pressure below tool 100 to an axial top side of the upper cone 135. The second pathway may be established between the non-sealing connection between the retainer 138 and the upper end of the upper cone 135. Fluid may migrate past this non-sealing connection, and into a radial space 182 between the upper cone 135 and the upper, outer mandrel 112. The radial space 182 may be sealed by the O-ring 176, for example. Accordingly, when the bottom side of the tool 100 is the high-pressure side, the pressure on both the top and the bottom of the upper cone 135 may be equalized, i.e., the pressure above may tend to drive the upper cone 135 into the slips 140 with equal force as the pressure below drives the upper cone 135 away from the slips 140, such that additional strain on shearable members or the like is avoided.

Figure 2:
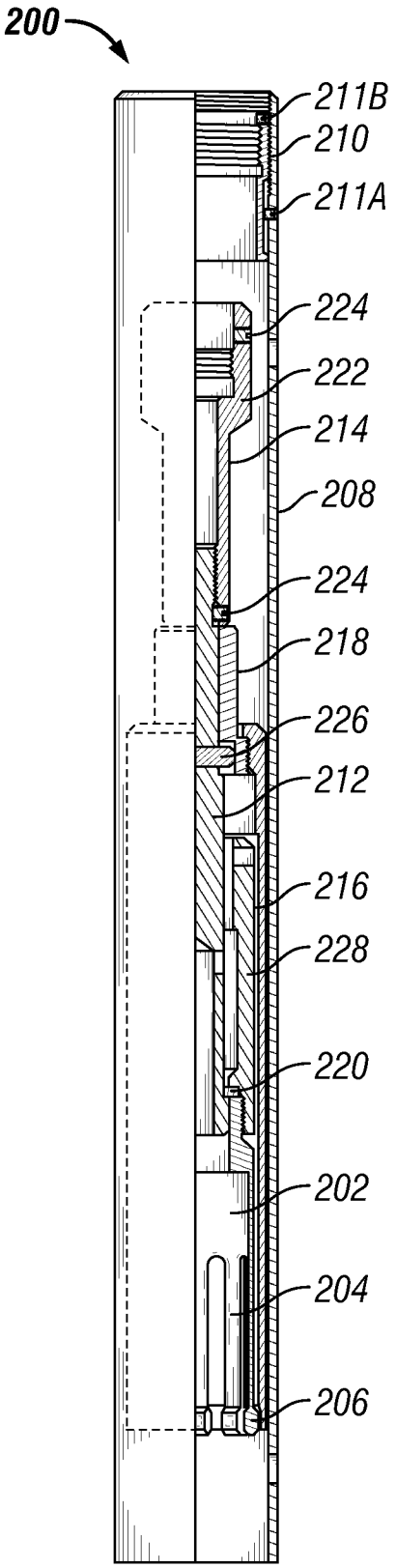
FIG. 2 illustrates a side, quarter-sectional view of a setting tool for use with the downhole tool, according to an embodiment.

FIG. 2 illustrates a side, quarter-sectional view of an adapter 200 for use with the downhole tool 100, according to an embodiment. The adapter 200 may be a wireline or electric line adapter, or any other suitable adapter. The adapter 200 may include a release collet 202, which may include deflectable fingers 204 and protrusions 206. The protrusions 206 may be configured to seat into the recess 111 (FIG. 1) of the upper connection 108 of the release mandrel 102.

The adapter 200 also includes a setting sleeve 208, which is disposed around the release collet 202 and is configured to bear against the lock-ring housing 120 when the adapter 200 engages the downhole tool 100. The adapter 200 further includes an outer adapter 210. Set screws 211A may be used to attach the outer adapter 210 to the setting sleeve 208, and set screws 211B may be provided to attach the outer adapter 210 to a setting tool.

The adapter 200 may further include a mandrel 212, an adjuster sub 214, a sleeve 216, and a torque nut 218, A pin 219 may be positioned within the torque nut 218, The release collet 202 may be coupled with the mandrel 212 and the sleeve 216, and a shear ring 220 may be disposed between the sleeve 216 and the release collet 202, A cap 228 may be positioned over the mandrel 212. The adjuster sub 214 may be coupled, e.g., threaded, to the mandrel 212, and may extend upward to form a connector 222. Set screws 224 may be received through the connector 222, such that the connector 222 connects with and may be held by a setting tool.

In operation, the setting sleeve 208 and the outer adapter 210 may engage a setting tool, which may push down on the setting sleeve 208 and the outer adapter 210. The setting sleeve 208 and the release collet 202 may be axially movable relative to one another. As such, the adapter 200 may transmit an axial downward force via the setting sleeve 208 onto the lock-ring housing 120, and an axial upward force via the release collet 202 onto the release mandrel 102.

Figure 3:
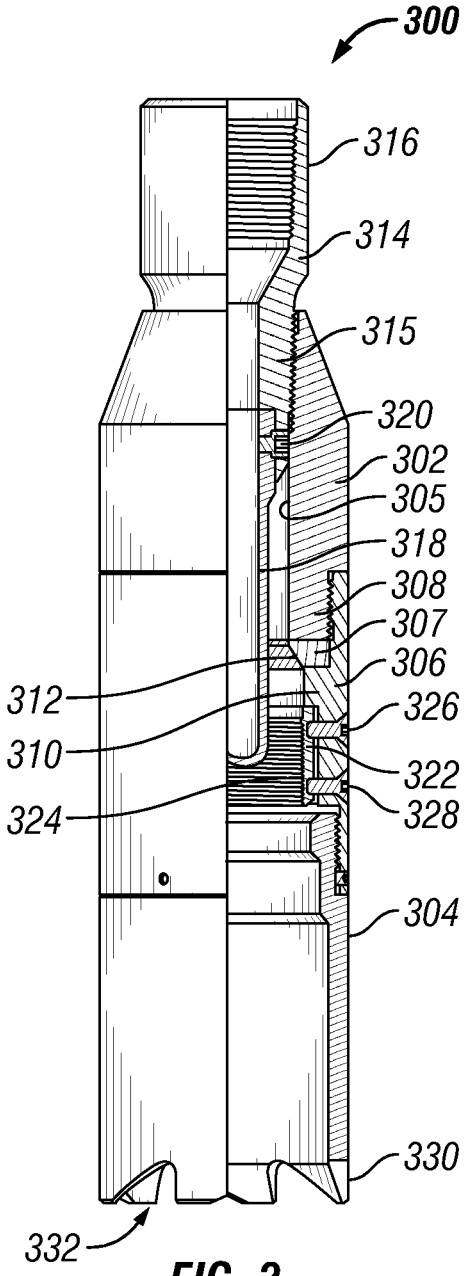
FIG. 3 illustrate a side, quarter-sectional view of a retrieval tool for use with the downhole tool, according to an embodiment.

FIG. 3 illustrates a side, quarter-sectional view of a retrieval tool 300, which may be used in combination with the downhole tool 100 (FIG. 1A), according to an embodiment. The retrieval tool 300 may include an upper sub 302, a lower sub (or "shoe") 304, and an intermediate sub 306 connecting together the upper and lower subs 302, 304. The upper and lower subs 302, 304 and the intermediate sub 306 may collectively define an inner bore 305 through the retrieval tool 300.

In an embodiment, a rubber stop 307 may be disposed between the upper sub 302 and the intermediate sub 306. For example, at a lower end 308, the upper sub 302 may define a smaller inner diameter than a shoulder 310 of the intermediate sub 306. The rubber stop 307 may be disposed between the shoulder 310 and the lower end 308. At least a portion of the rubber stop 307 may overhang the shoulder 310. For example, the rubber stop 307 may define a tapered inner surface 312 that may face downward and overhang the shoulder 310.

A probe 314 may be connected with a radial inside of the upper sub 302. The probe 314 may include a body 315 that defines a connection 316 extending upwards from the upper sub 302. The connection 316 may be configured to engage a wireline, e-line, or another type of tool, etc. Further, the connection 316 may be configured to engage with the lower connection 163 of the lower mandrel 106 of the downhole tool 100 (FIG. 1A). In an embodiment, the connection 316 may be internally threaded, as shown, but in others, may be externally threaded, or be connected with the wireline, e-line, or lower connection 163 via another type of connection. The body 315 may be connected to the upper sub 302, e.g., via meshing threads provided on the bore of the upper sub 302 and the outer surface of the body 315.

The probe 314 may also include a probe tip 318, which may extend downwards from the body 315 and past the rubber stop 307. In an embodiment, the probe tip 318 may be coupled with the body 315 via a set screw 320. The probe tip 318 may be angled, in some embodiments, to establish a point of contact. Further, the probe tip 318 may be configured to break the rupture disk 166 of the tool 100 (FIG. 1A).

The retrieval tool 300 may also include a lock ring 322, which may be coupled with and disposed radially inside of the intermediate sub 306. For example, the lock ring 322 may be disposed below the shoulder 310. The lock ring 322 may define threads 324, which may be configured to engage the threads 110 of the downhole tool 100 (FIG. 1A). Accordingly, the lock ring 322 may act as a ratchet by interaction with the threads 110, allowing the retrieval tool 300 to be set down on the downhole tool 100, but preventing the retrieval tool 300 from then being pulled away from the downhole tool 100. In an embodiment, the lock ring 322 may be coupled with the intermediate sub 306 by adjuster screws 326, 328.

The lower sub 304 may extend downward from the intermediate sub 306 and form a lower end 330 of the retrieval tool 300. At the lower end 330, the lower sub 304 may provide cut-aways 332, which may assist in the retrieval tool 300 moving through sand, debris, etc. of the downhole environment.

Figure 4A:
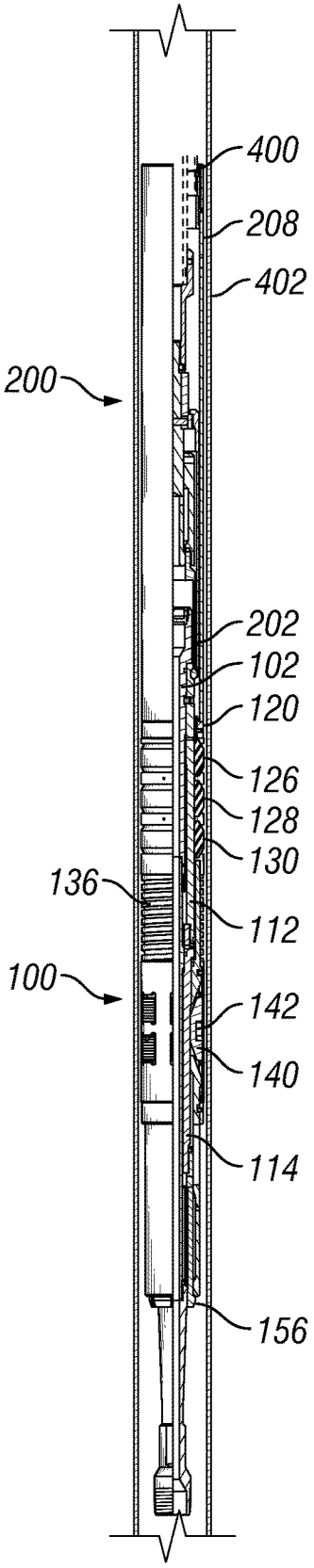
FIGS. 4A and 4B illustrate side, quarter-sectional views of a downhole tool system including the downhole tool and the setting tool, with the downhole tool in a run-in configuration and a set configuration, respectively, according to an embodiment.

FIG. 4A illustrates a side, quarter-sectional view of a downhole tool system in which the downhole tool 100 is coupled with the adapter 200, e.g., with the downhole tool still in a run-in configuration, according to an embodiment. As shown, the release collet 202 of the adapter 200 may engage the recess 111 formed in the upper, outer mandrel 112, proximal to the upper connection 108 (in some embodiments, the recess 111 may be considered part of the upper connection 108, despite being formed in the upper, outer mandrel 112). Further, the setting sleeve 205 may engage the lock-ring housing 120. In this configuration, a wireline 400, for example, may be used to deploy the tool 100 into the wellbore. As shown, in the run-in configuration, the sealing elements 126, 128, 130 are in a radially-contracted configuration, and axially-relaxed configuration. Similarly, the slips 140 are held at a radially-contracted position by the slips spring 142. As such, in the run-in configuration, the sealing elements 126, 128, 130 and the slips 140 may generally not engage with a surrounding tubular 402 (e.g., casing), or at least may not prevent run-in of the tool 100.

Upon reaching a desired depth in the wellbore, the adapter 200 may be employed to set the tool 100, e.g., move the tool 100 from the run-in configuration to the set-configuration. To set the tool 100, a hydraulic or explosive setting tool above the adapter 200 may be employed. The setting sleeve 208 of the adapter 200 may thus be forced downward relative to the tool 100, while the release collet 202 holds the upper, outer mandrel 112 (and thus the release mandrel 102) in place.

Figure 4B:
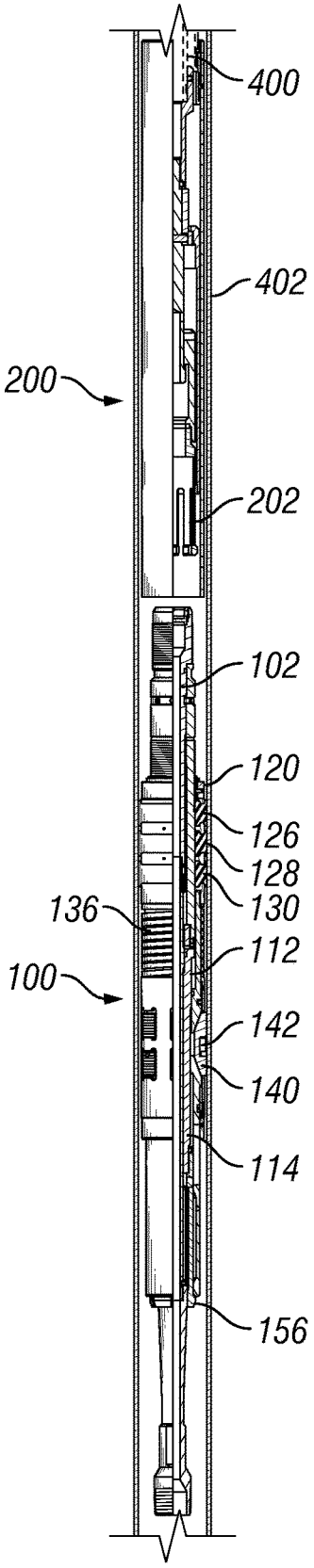

FIG. 4B illustrates a side, quarter-sectional view of the downhole tool system with the downhole tool 100 decoupled from the adapter 200, e.g., with the downhole tool 100 in a set configuration, according to an embodiment. Once the downhole tool 100 is moved into the set configuration, the release collet 202 may release from and be pulled away from the upper connection 108 of the tool 100, as shown in FIG. 4B. Comparing FIGS. 4A and 4B, illustrates that the release mandrel 102 of the tool 100 may generally remain stationary relative to the surrounding tubular 402 (and/or the adapter 200) during setting. Further, the lower mandrel 106 and the upper and lower, outer mandrels 112, 114 may similarly remain stationary.

In contrast, the setting sleeve 208 bearing on the lock-ring housing 120 causes shear screws 122, 149, and 151 to shear (but not necessarily in that order). The continued force by the setting sleeve 205 pushes the lock-ring housing 120 downwards, relative to the release mandrel 102, thereby axially squeezing and radially expanding the sealing elements 126, 128, 130. Further, the follower spring 136 is compressed against the retainer 138, applying a force against the upper cone 135. Since the lower mandrel 104 and the lower, outer mandrel 114 are stationary, the lower collet 156 remains entrained between the lower cone 150 and the lower, outer mandrel 114. Thus, the lower cone 150 is prevented from moving downward by interaction with the lower collet 156. Accordingly, as the upper cone 135 is driven downward, the lower cone 150 may remain stationary, and thus the distance between the upper and lower cones 135, 150 may be reduced, causing the upper and lower cones 135, 150 to push the slips 140 radially outwards, through the openings 148 and into engagement with the surrounding tubular 402.

The bore 168 of the tool 100 may be blocked by the rupture disk 166. Further, the annulus between the tool 100 and the surrounding tubular 402 may be sealed by the sealing elements 126, 128, 130. Accordingly, the tool 100 may support the production of a pressure differential above and below the first and third sealing elements 126, 128. As mentioned above, however, regardless of whether the higher-pressure side is above or below the sealing elements 126, 128, the high pressure may be communicated with the upper cone 135. Moreover, since the lower cone 150 rests on the lower collet 156, which is directly connected with the lower mandrel 114, the lower cone 150 may not require any shearable members or set screws to maintain the set configuration. Further, any pressure below the tool 100 may tend to push the lower cone 150 upwards, further into engagement with the slips 140, thus increasing the holding force of the tool 100.

Figure 5:
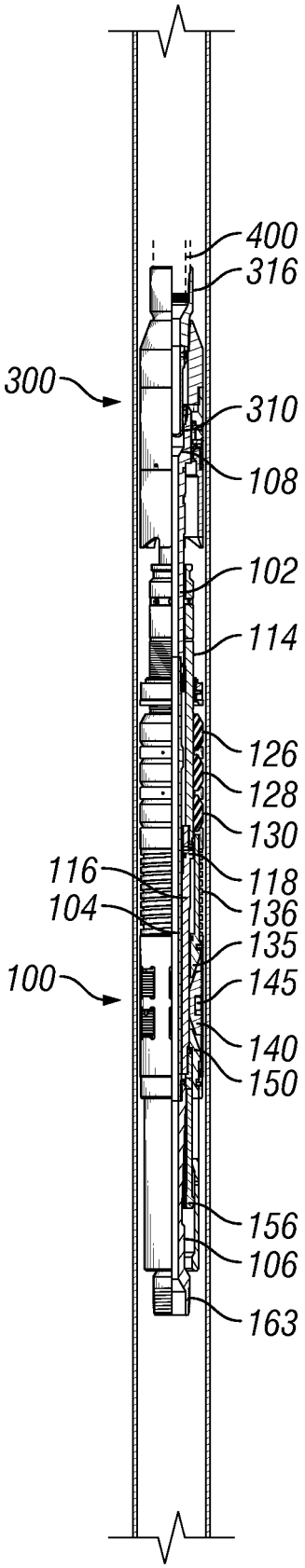
FIG. 5 illustrates a side, quarter-sectional view of the downhole tool system including the downhole tool and the retrieval tool, with the downhole tool in in a retrieval configuration, according to an embodiment.

FIG. 5 illustrates a side, quarter-sectional view of the retrieval tool 300 engaging the release mandrel 102 of the downhole tool 100, with the downhole tool 100 moved into a retrieval configuration, according to an embodiment. The retrieval tool 300 may be lowered onto the release mandrel 102 via a wireline or e-line attached to the connection 316 of the retrieval tool 300, such that the upper connection 108 is received through the lower end of the retrieval tool 300. In other embodiments, another downhole tool, similar or identical to the illustrated downhole tool 100 may be positioned above (i.e., superposed) with respect to the illustrated downhole tool 100, and the lower connection (corresponding to the lower connection 163 of the illustrated downhole tool 100) of the superposed tool may be connected with the connection 316 of the retrieval tool 300. Similarly, a second retrieval tool may be coupled with the lower connection 163, for engagement with another, subjacent retrievable tool.

Accordingly, for example, several downhole tools 100 may be employed in a single wellbore and retrieved as a single unit. For example, a retrieval tool 300 may be coupled with the lower connection 163 of each of the downhole tools 100. When it is desired to retrieve the downhole tools 100, a retrieval tool 300 may be coupled with the upper connection 108 of the top-most downhole tool 100, so as to release that downhole tool 100. The downhole tool 100, with the retrieval tools 300 coupled to both the upper and lower connections 108, 163 thereof may then be moved lower in the wellbore, until the retrieval tool 300 connected with the lower connection 163 then engages the upper connection 108 of the next-lower downhole tool 100. The next-lower downhole tool 100 may then release, with the forces discussed above being applied through the top-most downhole tool 100 and the retrieval tool 300 disposed between the two downhole tools 100. This second downhole tool 100 may thus be released from the wellbore, and may drop down such that the retrieval tool 300 connected to its lower connection 163 engages another downhole tool 100. This process may repeat as many times as desired.

The retrieval tool 300 may receive the external threads 110 (see FIG. 1A) of the upper connection 108 into the lock ring 322. The lock ring 322 may provide a ratcheting function, as described above, and may thus prevent the retrieval tool 300, once engaging the external threads 110, from separating from the release mandrel 102. As the retrieval tool 300 is set down onto the upper connection 108, the connection 108 may seal with the rubber stop 307, so as to prevent fluid communication out of the bore 305 (see FIG. 3) of the retrieval tool 300.

As the retrieval tool 300 is set down on the release mandrel 102, the probe tip 318 may engage and break through the rupture disk 166 (see FIG. 1A). Since the retrieval tool 300 may have the through-going bore 305, and the downhole tool 100 may also have the through-going bore 168, rupturing the rupture disk 166 may restore fluidic communication between previously-isolated locations above and below the first and third sealing elements 126, 130.

The inner components of the retrieval tool 300, described above with reference to FIG. 3, may then cooperate to transmit an upward pulling force to the release mandrel 102 via upper connection 108. Eventually, this force may shear the shear screw 116 between the release mandrel 102 and the upper, outer mandrel 114 (see FIG. 1A). The release mandrel 102 and, thus, the lower mandrel 106 may then be pulled upwards with respect to the surrounding tubular 402 and the other components of the downhole tool 100. With the tapered, lower mandrel 106 moved upward, the lower collet 156 may be released from engagement with the lower cone 150. The release of the lower collet 156 may free the lower cone 150 to move downward, away from the slips 140. Further, this may free the upper cone 135, engaging the shoulder 118 of the lower, outer mandrel 114, which is attached to the collet 156, to move upwards, away from the slips 140. During this transition, pressure may equalize on both sides of the tool 100, removing the above-described holding effects relying on pressure differential in the wellbore.

At this point, the tool 100 is in a relaxed state, and the previously axially compressed sealing elements 126, 128, 130, e.g. as pushed by the follower spring 136, may move axially upward, and may expand axially and contract radially away from the surrounding tubular 402. Further, the upper and lower cones 135, 150 may fail to overcome the inward biasing force on the slips 140 applied by the slip spring 142, thus allowing the slips 140 to retract radially inwards. At this point, the tool 100 may be in a retrievable configuration, in which the tool 100 may be removed from the wellbore.

Figure 6:
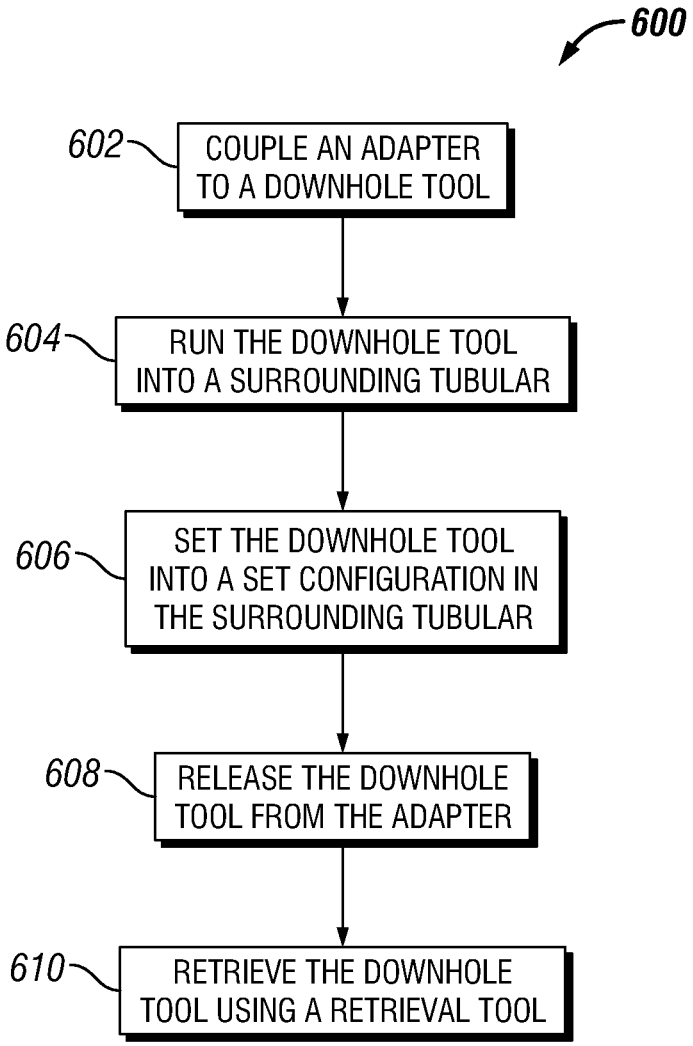
FIG. 6 illustrates a flowchart of a method for running and retrieving a downhole tool, according to an embodiment.

FIG. 6 illustrates a flowchart of a method 600 for running and retrieving a downhole tool into a surrounding tubular. The method 600 may be best understood with reference to the foregoing description of the downhole tool 100, adapter 200, and/or retrieval tool 300. However, at least some embodiments may operate by use of other structures and thus may not be limited specifically to the foregoing apparatus.

The method 600 may include coupling an adapter to the downhole tool, as at 602. In an embodiment, the downhole tool may include a release mandrel comprising an upper connection coupled with the adapter, and a plurality of slips disposed at least partially around the release mandrel. The downhole tool may also include an upper cone disposed at least partially around the release mandrel and on a first axial side of the plurality of slips, and a lower cone disposed at least partially around the release mandrel and on a second axial side of the plurality of slips. The downhole tool may further include a collet positioned axially and radially between the release mandrel and the lower cone. The collet may be configured to prevent downward movement of the lower cone relative to the release mandrel, when the downhole tool is in a run-in configuration. The method 600 may also include running the downhole tool into the surrounding tubular using the adapter, as at 604.

The method 600 may also include setting the downhole tool into a set configuration in the surrounding tubular, using the adapter, as at 606. In an embodiment, setting the downhole tool may include moving at least the upper cone and the plurality of slips downward with respect to the release mandrel and the lower cone. Further, the release mandrel may be held substantially stationary (e.g., the release mandrel may move to a limited degree, but such movement is not used to effect the setting) with respect to the surrounding tubular. Furthermore, moving the upper cone and the plurality of slips downward may include bringing the upper cone and the lower cone closer together and expanding the plurality of slips outward to engage the surrounding tubular. The collet may prevent the lower cone from moving away from the plurality of slips.

The method 600 may also include releasing the downhole tool from the adapter, as at 608. The method 600 may also include retrieving the downhole tool using a retrieval tool, as at 610. For example, the downhole tool may include an outer mandrel coupled with the release mandrel by one or more shear devices, and coupled with the collet so as to be constrained to move therewith. Retrieving at 610 may thus include shearing the one or more shear devices and moving the release mandrel relative to the outer mandrel and the collet.

In an embodiment, the downhole tool may further include one or more sealing elements. For example, setting the downhole tool at 606 may include engaging the surrounding tubular using the one or more sealing elements by axially compressing and radially expanding the one or more sealing elements. Further, retrieving the downhole tool at 610 may include allowing the one or more sealing elements to axially expand and radially contract. The downhole tool may also include a first fluid passage extending from a first axial side of the one or more sealing elements to the upper cone, with the upper cone being positioned on a second axial side of the one or more sealing elements. The downhole tool may further include a second fluid passage configured to communicate pressure to the upper cone. The pressure communicated to the upper cone may tend to push the upper cone toward the plurality of slips.

The downhole tool may also include a rupture disk positioned in a bore extending through the release mandrel, to prevent fluid communication through the release mandrel. Accordingly, the retrieving at 610 may also include rupturing the rupture disk using a probe tip of the retrieval tool, such that pressure above and below the one or more sealing elements is substantially equalized.

In an embodiment, the release mandrel may further include an upper connection that is coupled with the adapter when running the downhole tool into the surrounding tubular, and a lower connection that is coupled with a second retrieval tool when running the downhole tool into the wellbore. Accordingly, retrieving at 610 may further include engaging a second upper connection of a second downhole tool using the second retrieval tool, while the second retrieval tool is connected with the lower connection.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:
- a release mandrel;
- a plurality of slips disposed at least partially around the release mandrel;
- an upper cone disposed at least partially around the release mandrel and on a first axial side of the plurality of slips;
- a lower cone disposed at least partially around the release mandrel and on a second axial side of the plurality of slips;
- a collet positioned axially and radially between the release mandrel and the lower cone, wherein the collet is configured to prevent downward movement of the lower cone relative to the release mandrel at least when the downhole tool is in a run-in configuration and when the downhole tool is in a set configuration;
- one or more sealing elements;
- a first fluid passage configured to communicate pressure from a first axial side of the one or more sealing elements to the upper cone, wherein the upper cone is positioned on a second axial side of the one or more sealing elements; and
- a second fluid passage configured to communicate pressure to the upper cone, wherein the pressure communicated to the upper cone pushes the upper cone toward the plurality of slips.

2. The downhole tool of claim 1, wherein the release mandrel comprises a tapered lower portion that increases in diameter as proceeding toward the plurality of slips, and wherein the collet engages the tapered lower portion, such that the tapered lower portion prevents the collet from releasing from the lower cone.

3. The downhole tool of claim 1, wherein the release mandrel comprises:

an upper connection configured to engage an adapter, a first retrieval tool, or both; and a lower connection configured to engage a second retrieval tool.

4. The downhole tool of claim 1, further comprising:

an outer mandrel that is coupled with the collet so as to be constrained to move therewith; and one or more shear devices that couple the outer mandrel with the release mandrel, so as to prevent relative movement between the outer mandrel and the release mandrel, until the one or more shear devices shear.

5. The downhole tool of claim 4, wherein, when the one or more shear devices shear, the release mandrel is permitted to move relative to the outer mandrel, and the collet is permitted to move relative to the lower cone, such that the collet permits the lower cone to move away from the plurality of slips.

6. The downhole tool of claim 1, further comprising a rupture disk positioned in a bore defined axially through the release mandrel, wherein the rupture disk, prior to rupturing, prevents fluid communication through the bore, and wherein the rupture disk, after rupturing, permits fluid communication through the bore.

7. A retrievable bridge plug system, comprising:

a bride plug comprising:

a release mandrel comprising an upper connection;

an outer mandrel coupled to the release mandrel by one or more shear devices;

a plurality of slips disposed at least partially around the release mandrel;

an upper cone disposed at least partially around the release mandrel and on a first axial side of the plurality of slips;

a lower cone disposed at least partially around the release mandrel and on a second axial side of the plurality of slips;

a collet coupled with the outer mandrel and positioned axially and radially between the release mandrel and the lower cone, wherein the collet is configured to prevent downward movement of the lower cone relative to the release mandrel at least when the bridge plug is in a set configuration;

one or more sealing elements;

a first fluid passage configured to communicate pressure from a first axial side of the one or more sealing elements to the upper cone, wherein the upper cone is positioned on a second axial side of the one or more sealing elements; and a second fluid passage configured to communicate pressure to the upper cone, wherein the pressure communicated to the upper cone pushes the upper cone toward the plurality of slips; and a retrieval tool having an upper end and a lower end, the retrieval tool being configured to receive the upper connection of the release mandrel through the lower end, and to shear the one or more shear devices, so as to move the bridge plug from a set configuration to a retrieval configuration.

8. The system of claim 7, wherein:

the retrieval tool comprises a lock ring having threads; and the upper connection has threads, the threads of the lock ring being configured to engage the threads of the upper connection, so as to allow movement of the release mandrel into the retrieval tool, but prevent separation of the release mandrel and the retrieval tool.

9. The system of claim 8, wherein the retrieval tool further comprises a rubber stopper that is positioned such that, when the upper connection of the retrieval tool is engaged by the lock ring, the upper connection seals with the rubber stopper.

10. The system of claim 7, wherein:

the bridge plug comprises a rupture disk configured to prevent fluid communication through a bore of the release mandrel; and the retrieval tool comprises a probe having a probe tip configured to rupture the rupture disk.

11. The system of claim 7, wherein the release mandrel comprises a tapered lower mandrel that increases in diameter as proceeding toward the plurality of slips, and wherein the collet engages the tapered lower mandrel.

12. The system of claim 7, wherein the release mandrel further comprises a lower connection configured to engage an upper end of a second retrieval tool.

13. The system of claim 7, wherein, when the one or more shear devices shear, the release mandrel is permitted to move relative to the outer mandrel, and the collet is permitted to move relative to the lower cone, such that the collet permits the lower cone to move away from the plurality of slips.

14. A method for running and retrieving a downhole tool into a surrounding tubular, comprising:

coupling an adapter to the downhole tool, the downhole tool comprising:

a release mandrel comprising an upper connection coupled with the adapter;

a plurality of slips disposed at least partially around the release mandrel;

an upper cone disposed at least partially around the release mandrel and on a first axial side of the plurality of slips;

a lower cone disposed at least partially around the release mandrel and on a second axial side of the plurality of slips;

a collet positioned axially and radially between the release mandrel and the lower cone, wherein the collet is configured to prevent downward movement of the lower cone relative to the release mandrel, when the downhole tool is in a run-in configuration;

one or more sealing elements, wherein setting the downhole tool comprises engaging the surrounding tubular using the one or more sealing elements by axially compressing and radially expanding the one or more sealing elements, and wherein retrieving the downhole tool comprises allowing the one or more sealing elements to axially expand and radially contract;

a fluid passage extending from a first axial side of the one or more sealing elements to the upper cone, wherein the upper cone is positioned on a second axial side of the one or more sealing elements;

a second fluid passage configured to communicate pressure to the upper cone, wherein the pressure communicated to the upper cone tends to push the upper cone toward the plurality of slips; and a rupture disk positioned in a bore extending through the release mandrel, to prevent fluid communication through the release mandrel;

running the downhole tool into the surrounding tubular using the adapter;

setting the downhole tool into a set configuration in the surrounding tubular using the adapter; and releasing the downhole tool from the adapter.

15. The method of claim 14, wherein setting the downhole tool comprises moving at least the upper cone and the plurality of slips downward with respect to the release mandrel and the lower cone, wherein the release mandrel is held substantially stationary with respect to the surrounding tubular.

16. The method of claim 15, wherein moving at least the upper cone and the plurality of slips downward comprises bringing the upper cone and the lower cone closer together and expanding the plurality of slips outward to engage the surrounding tubular, wherein the collet prevents the lower cone from moving away from the plurality of slips.

17. The method of claim 14, wherein:

the downhole tool further comprises an outer mandrel coupled with the release mandrel by one or more shear devices, and coupled with the collet so as to be constrained to move therewith; and retrieving the downhole tool comprises shearing the one or more shear devices and moving the release mandrel relative to the outer mandrel and the collet.

18. The method of claim 14, further comprising retrieving the downhole tool using a retrieval tool, wherein retrieving the downhole tool comprises rupturing the rupture disk using a probe tip of the retrieval tool, such that pressure above and below the one or more sealing elements is substantially equalized.

19. The method of claim 14, wherein:

the upper connection is coupled with the adapter when running the downhole tool into the surrounding tubular, and wherein the release mandrel further comprises a lower connection that is coupled with a second retrieval tool when running the downhole tool into the surrounding tubular, the method further comprising engaging a second upper connection of a second downhole tool using the second retrieval tool, while the second retrieval tool is connected with the lower connection.

20. A method for running and retrieving a downhole tool into a surrounding tubular, comprising:

coupling an adapter to the downhole tool, the downhole tool comprising:

a release mandrel comprising an upper connection coupled with the adapter;

a plurality of slips disposed at least partially around the release mandrel;

an upper cone disposed at least partially around the release mandrel and on a first axial side of the plurality of slips;

a lower cone disposed at least partially around the release mandrel and on a second axial side of the plurality of slips; and a collet positioned axially and radially between the release mandrel and the lower cone, wherein the collet is configured to prevent downward movement of the lower cone relative to the release mandrel, when the downhole tool is in a run-in configuration;

running the downhole tool into the surrounding tubular using the adapter;

setting the downhole tool into a set configuration in the surrounding tubular using the adapter;

releasing the downhole tool from the adapter, wherein the upper connection is coupled with the adapter when running the downhole tool into the surrounding tubular, and a lower connection that is coupled with a second retrieval tool when running the downhole tool into the surrounding tubular; and engaging a second upper connection of a second downhole tool using the second retrieval tool while the second retrieval tool is connected with the lower connection.

* * * * *